US009290356B2

(12) United States Patent
Viviroli

(10) Patent No.: US 9,290,356 B2
(45) Date of Patent: Mar. 22, 2016

(54) WIRE TRANSPORTING SYSTEM

(75) Inventor: Stefan Viviroli, Horw (CH)

(73) Assignee: Komax Holding AG, Dierikon (CH)

( * ) Notice: Subject to any disclaimer, the term of this patent is extended or adjusted under 35 U.S.C. 154(b) by 852 days.

(21) Appl. No.: 13/446,236

(22) Filed: Apr. 13, 2012

(65) Prior Publication Data

US 2012/0261454 A1 Oct. 18, 2012

(30) Foreign Application Priority Data

Apr. 13, 2011 (EP) ..... 11162191

(51) Int. Cl.

| | |
|---|---|
| ***B65H 51/18*** | (2006.01) |
| ***B65H 51/14*** | (2006.01) |
| ***B65H 51/28*** | (2006.01) |
| ***B65H 51/32*** | (2006.01) |
| ***B65H 54/78*** | (2006.01) |

(52) U.S. Cl.

CPC ..... *B65H 51/14* (2013.01); *B65H 51/18* (2013.01); *B65H 51/28* (2013.01); *B65H 51/32* (2013.01); *B65H 54/78* (2013.01); *B65H 2701/341* (2013.01)

(58) Field of Classification Search

CPC ..... B65H 51/14; B65H 51/18; B65H 51/28; B65H 51/32; B65H 54/78; B65H 2701/341

See application file for complete search history.

(56) References Cited

U.S. PATENT DOCUMENTS

| | | | |
|---|---|---|---|
| 4,663,822 | A | 5/1987 | Blaha et al. |
| 2001/0025870 | A1 | 10/2001 | Hasegawa |
| 2007/0261228 | A1 | 11/2007 | Locher et al. |

FOREIGN PATENT DOCUMENTS

| | | | |
|---|---|---|---|
| DE | 3121950 | A1 | 12/1982 |
| EP | 0221482 | A1 | 5/1987 |
| FR | 2700599 | A1 | 7/1994 |
| WO | 2004040182 | A1 | 5/2004 |

*Primary Examiner* — William E Dondero

(74) *Attorney, Agent, or Firm* — Fraser Clemens Martin & Miller LLC; William J. Clemens

(57) ABSTRACT

In a wire-processing machine, a belt-drive feeds a wire to a first swivel-arm with a first gripper. To feed the leading wire-end to processing stations, the first swivel-arm is set in a swiveling motion and/or in a linear motion. To feed the trailing wire-end to processing stations, the second swivel-arm is set in a swiveling motion and/or in a linear motion. After processing of the leading wire-end, by means of the belt-drive the desired cut-off length of wire is advanced and, by means of a transporting system, is transported further.

9 Claims, 7 Drawing Sheets

WIRE TRANSPORTING SYSTEM

CROSS-REFERENCE TO RELATED APPLICATION

This application claims priority to European Patent Application No. 11162191.8, filed Apr. 13, 2011, which is incorporated herein by reference.

FIELD

The disclosure relates to wire processing.

BACKGROUND

For the purpose of being processed, the wire that is to be processed in a wire-processing machine is transported into the machine and, after processing, is transferred to a receptacle. In essence, by means of an advancing device, the wire is taken from a wire stock and, depending on the desired length of wire that is to be cut, pushed into the machine.

While being advanced, the wire, as a flexible element, is susceptible to undesired movements and deformations. The wire can become caught on machine parts, or bend, and/or enter undesired areas of the machine. The wire can also move forward slower or faster than desired. When doing so, the wire can jam, or become damaged, or hinder the correct processing of subsequent wires.

SUMMARY

In at least some embodiments of the disclosed technologies, the wire is not pushed, but is pulled, into the wire-processing device or wire-processing machine. Instead of a conveyor belt, a belt-drive type of transporting system is provided.

On two circulating belts that are arranged in parallel, projecting conveyor elements are arranged in such manner that the conveyor elements of the one belt are adjacent to the conveyor elements of the other belt. Depending on the position of the adjacent conveyor elements relative to each other, they act to guide, embrace, or grip the wire that is lying between the guide elements, or to release the wire. The position of the guide elements, and hence their function, is influenced by the belts being moved codirectionally or contradirectionally.

Compared to a conveyor belt, with the transporting system the wire can be better guided and controlled. Collisions of the wire with other wires or machine parts can be prevented. Operational malfunctions and processing faults in the machine can thereby be reduced.

On running-in of the belts, the conveyor elements execute a convergent movement, the wire on running-in being horizontally captured and centered by means of the conveyor elements.

With the improved guidance of the wire, the processing speed of the machine can be increased without detriment to reliability. During transport, the wire comes into contact with very few parts of the machine that are stationary, or moving at a different speed, whereby damage to the wire, or to parts fastened thereto, is avoided.

Although the wire is held by the transporting system, the wire can twist around the longitudinal axis of the wire and thus release torsional stress. The transporting system is simply constructed and has low moving mass. Neither energy nor control signals must be transmitted to the belt. The transporting system can accept wires horizontally at the entrance or at the exit. The wires can also be laid in from above and/or released below. The transporting apparatus can move held wires forwards and backwards horizontally in the longitudinal axis of the wire.

BRIEF DESCRIPTION OF THE DRAWINGS

The disclosed technologies are described with reference to these figures.

DETAILED DESCRIPTION

Figure 1:
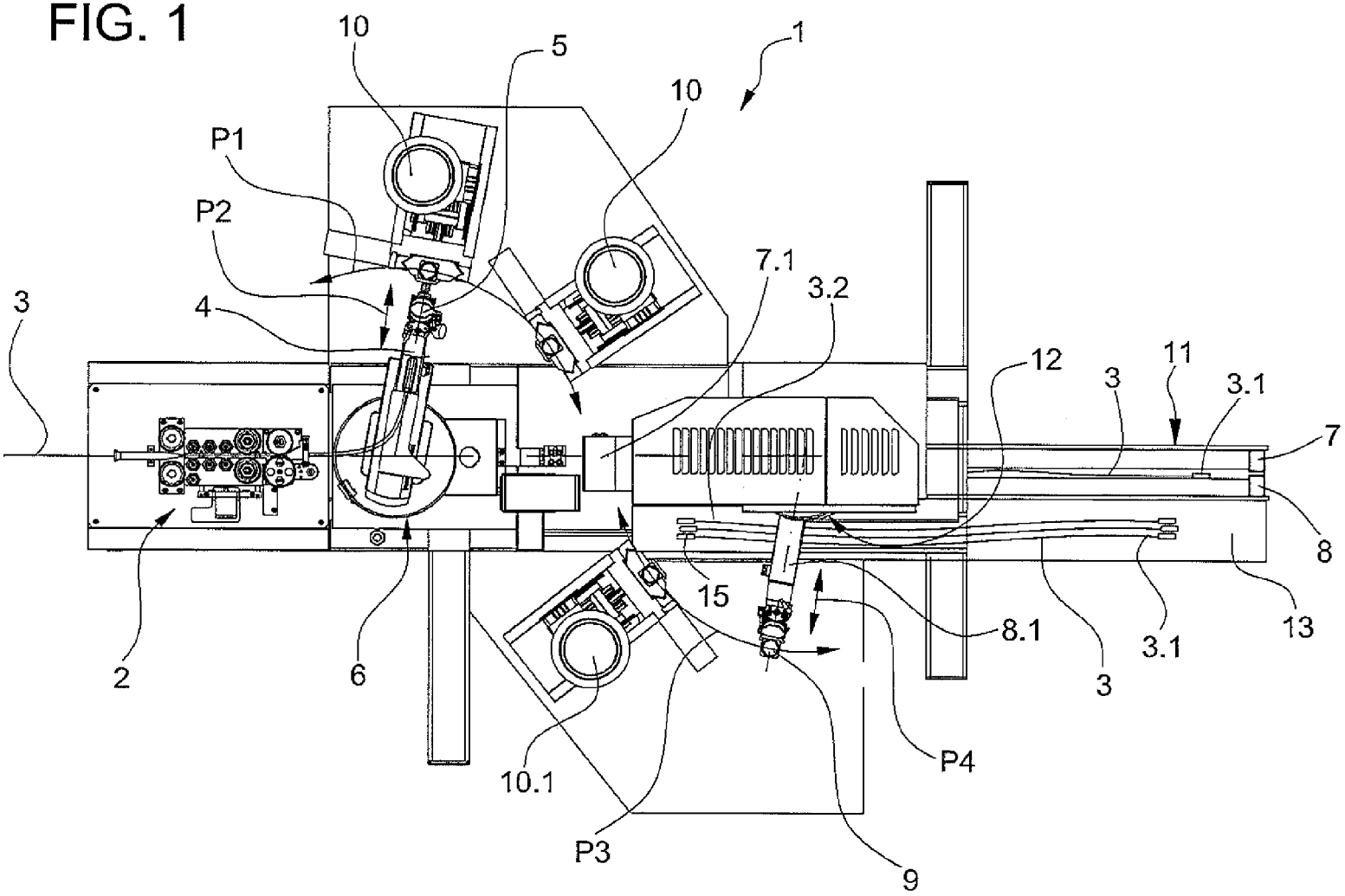
FIG. 1, a wire-processing machine with two swivel-arms and a transporting system.

FIG. 1 shows an exemplary embodiment of a wire-processing machine 1 with a wire-advancing device that is embodied as a belt-drive 2, the belt-drive 2 feeding a wire 3 to a first swivel-arm 4 with a first gripper 5. By means of first drives 6, the first swivel-arm 4 can be set in a swivel motion symbolized with an arrow P1 and/or in a linear motion symbolized by an arrow P2. By means of cutting/insulation-stripping blades 7.1, the wire can be separated and/or stripped of insulation.

In addition, the wire-processing machine 1 has a second swivel-arm 8.1 with a second gripper 9. By means of second drives 12, the second swivel-arm 8.1 can be set in a swiveling motion symbolized with an arrow P3, and/or in a linear motion symbolized with an arrow P4. By means of turning movement P1 and linear movement P2, the first swivel-arm 4, as feeding device, serves leading wire-ends 3.1 to first processing stations 10 (for example crimp presses and/or seal-mounters), which are arranged to the side of the longitudinal axis of the wire. By means of turning movement P3 and linear movement P4, the second swivel-arm 8.1, which is set in motion by the second drives 12, serves, as feeding device, trailing wire-ends 3.2 to processing stations 10 (for example crimp presses and/or seal-mounters), which are arranged to the side of the longitudinal axis of the wire. After processing of the leading wire-end 3.1, the wire 3 is transported further by means of a transporting system 11. The second gripper 9 grasps the trailing wire-end 3.2, following which the wire 3 is separated and the trailing wire-end 3.2 is stripped of insulation and fed to a second processing station 10.1. After processing of the trailing wire-end 3.2, the wire 3 arrives in a receptacle 13.

Figure 2:
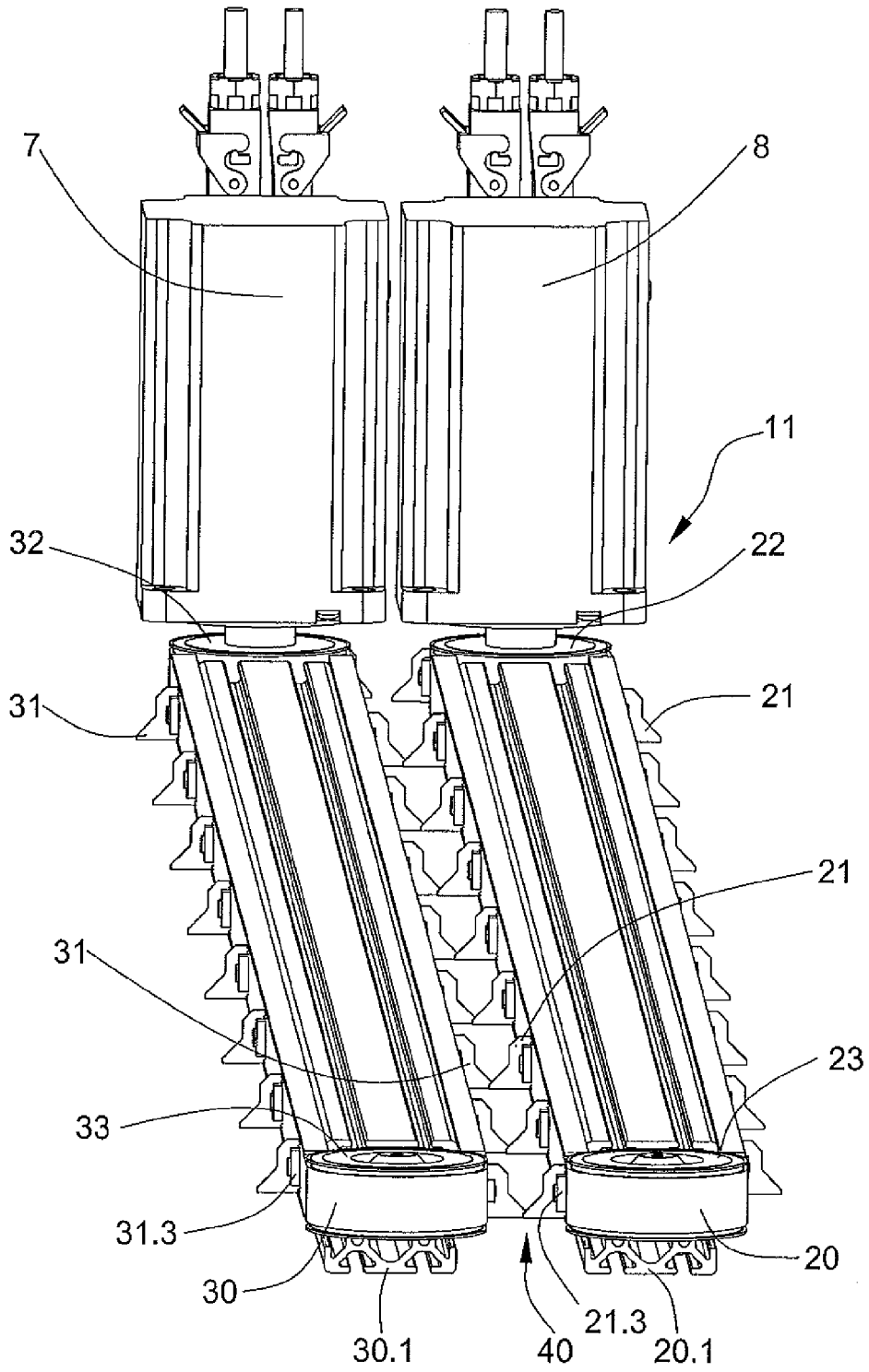
FIG. 2, a three-dimensional representation of the transporting system for transporting a wire in closed position.
Figure 2A:
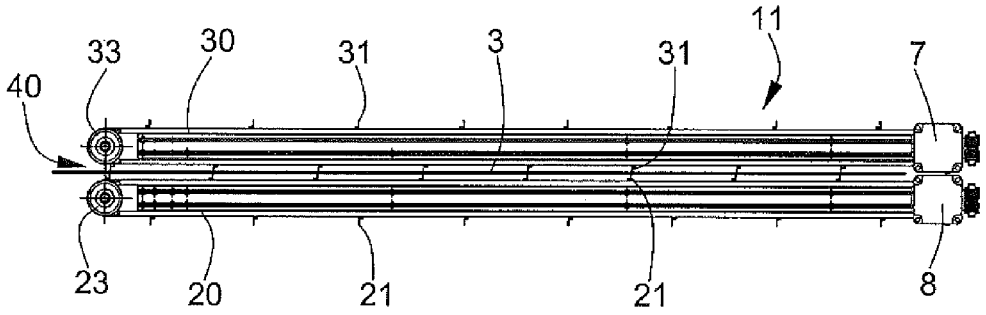
FIG. 2*a*, a plan view of the transporting system for transporting the wire in closed position.
Figure 2B:
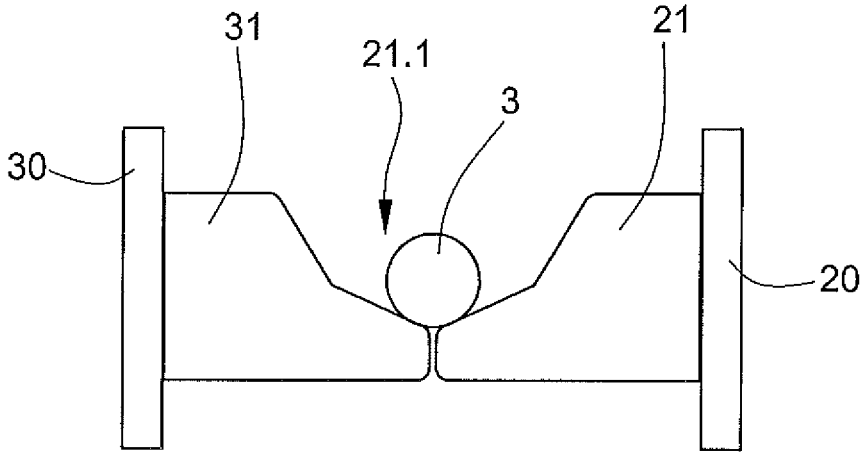
FIG. 2*b*, details of the conveyor elements for supporting and transporting the wire.

FIG. 2, FIG. 2*a*, and FIG. 2*b* show the transporting system 11 in the position that transports the wire 3, which is also known as the "closed position". The transporting system 11 consists of a pair of symmetrically constructed halves. A plurality of pairs of halves can also be arranged in cascade. A first half comprises a first conveyor device with a first endless belt, for example a belt 20, which, by means of a first drive pulley 22 and a first reversing pulley 23, is reversed. The first pulleys 22, 23 are fastened to a first support 20.1. The first drive pulley 22 is driven by means of a first motor 8. Arranged on the first belt 20, for example at regular intervals, are first conveyor elements 21. Irregular intervals are also possible.

A second half comprises a second conveyor device with a second endless belt, for example a belt 30, which, by means of a second drive pulley 32 and a second reversing pulley 33, is reversed. The second pulleys 32, 33 are fastened to a second support 30.1. The second drive pulley 32 is driven by means of a second motor 7. Arranged on the second belt 30, for example at regular intervals, are second conveyor elements 31. Irregular intervals are also possible. By means of fastening elements 21.3, 31.3, for example with screwed fasteners or riveted fasteners, the conveyor elements are connected to the belt 20, 30. The conveyor elements 21, 31 are, for example, of metal, or plastic, or natural rubber, and can be rigid or elastic.

As shown in FIGS. 2, 2*a* and 2*b*, in the position of the transporting system 11 in which the wire 3 is transported, the conveyor elements 21, 31 of the one conveyor device 20, 30 are adjacent to the conveyor elements 21, 31 of the other conveyor device 20, 30, and thereby support and transport the wire 3.

FIG. 2*b* shows how the wire 3 is supported by the first conveyor element 21 and by the second conveyor element 31. Together, the conveyor elements 21, 31 form a concave cross-sectional profile 21.1, which accommodates the wire 3. In the closed position of the conveyor elements 21, 31 as shown in FIG. 2, FIG. 2*a* and FIG. 2*b*, the first belt 20 and the second belt 30 are driven synchronously (in terms of velocity and position). Every first conveyor element 21 of the first belt 20 forms, together with its adjacent second conveyor element 31 of the second belt 30, a concave, for example a U- or V-shaped, cross-sectional profile 21.1, as shown in FIG. 2*b*.

The motors 7, 8 are, for example, servomotors, which are equipped with angle-measuring systems, for example encoders. The positions of the motor rotors, and hence also the positions of the conveyor elements 21, 31 relative to each other, are detectable, and a control that controls the wire-processing machine 1 can control the relative position of the conveyor elements 21, 31. Should varying intervals between the conveyor elements be foreseen, the absolute positions of the sensors are detected by means of, for example, positionally fixed sensors, which, for example, detect the conveyor elements 21, 31.

Figure 3A:
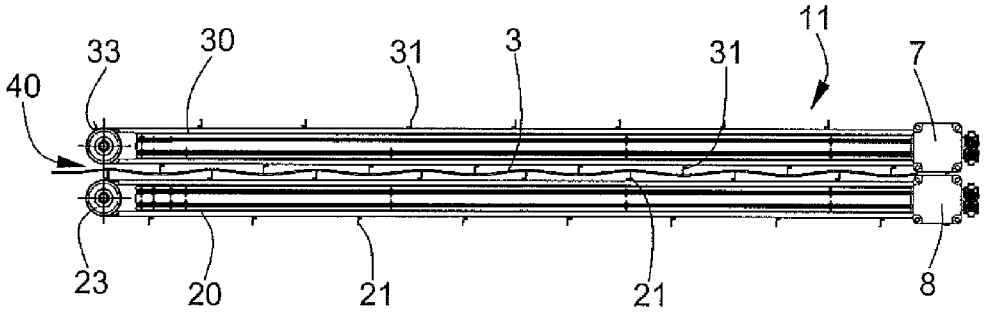
FIG. 3*a*, a plan view of the transporting system for releasing the wire in open position.
Figure 3:
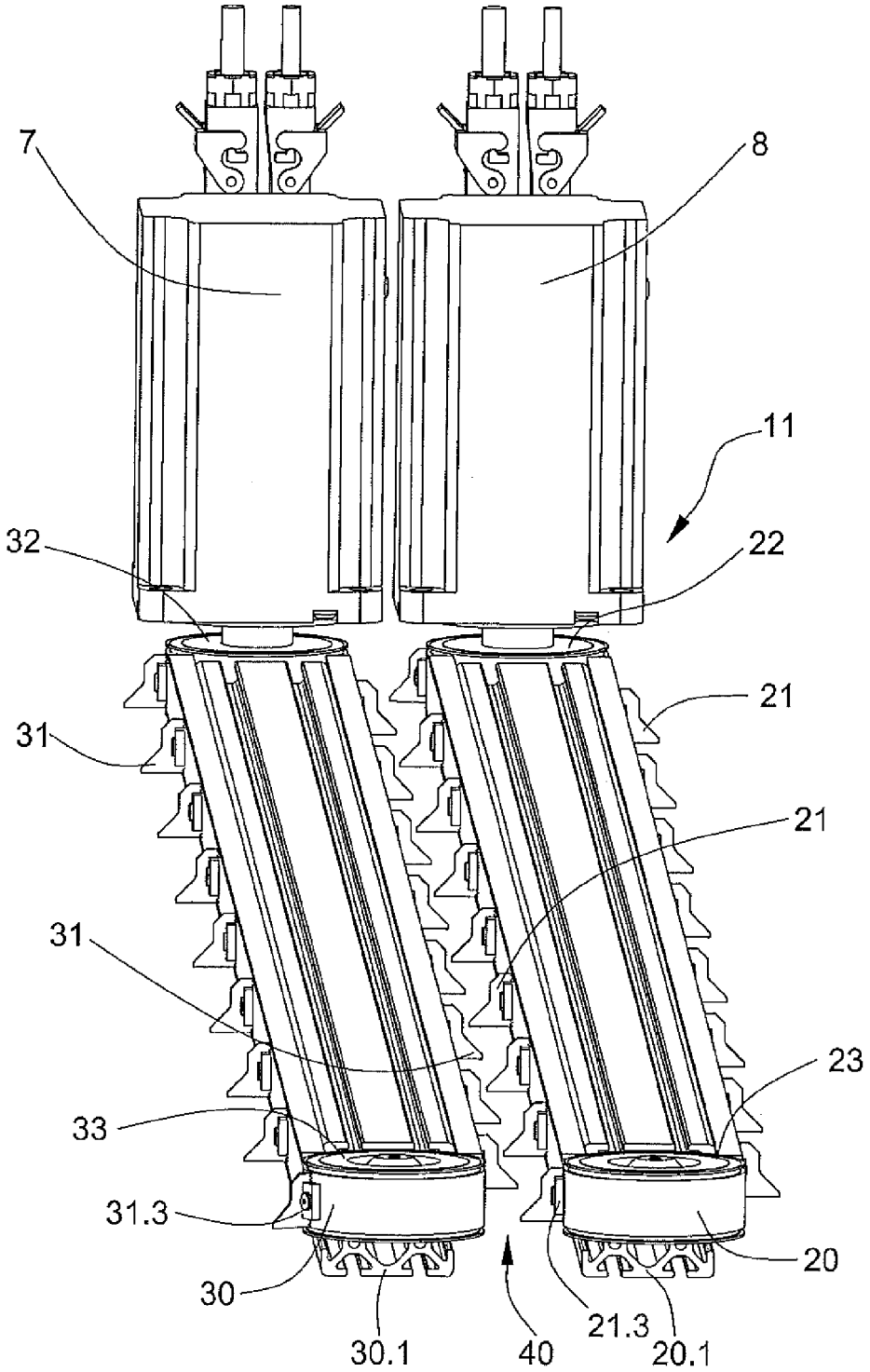
FIG. 3, a three-dimensional representation of the transporting system in open position for releasing the wire.

FIG. 3 and FIG. 3*a* show the transporting system 11 in a position of releasing the wire 3, also known as "open position". The two belts 20, 30 are moved relative to each other, the first conveyor element 21 moving relative to the second conveyor element 31 (or vice versa, or both). With the relative movement of the conveyor elements 21, 31 in the direction of the longitudinal axis of the wire, the concave cross-sectional profile 21.1 ceases to exist. The wire 3 cannot be supported and/or transported by the first conveyor elements 21 alone, or by the second conveyor elements 31 alone, and is released, and the wire 3 falls in downward direction. As shown in FIG. 3*a*, the relative movement of the conveyor elements 21, 31 in the direction of the longitudinal axis of the wire is such that the distance between a first conveyor element 21 and a second conveyor element 31 is of approximately the same magnitude as between a second conveyor element 31 and a first conveyor element 21. The wire 3 rests in a sinuous line adjacent to the conveyor elements 21, 31 and is then released, or falls, in downward direction into the receptacle 13.

As stated above, the belt-drive 2 advances the leading wire-end 3.1 as far as the first gripper 5, which swivels the leading wire-end 3.1 sideways and feeds it to first processing stations 10 for processing. The processed leading wire-end 3.1 is then swiveled back into the starting position and, by means of belt-drive 2, is advanced further, whereby the leading wire-end 3.1 arrives at an entrance of the transporting system 11, which is designated with 40. By means of the conveyor elements 21, 31, the belts 20, 30, whose velocity is synchronized with the belt-drive 2, pick up the wire 3 as shown in FIG. 2*b*. The conveyor elements 21, 31 center and transport the wire 3 for as long as the belt-drive 2 advances the wire 3 until the desired cut-off length of wire is attained. The cut-off length of wire is then separated from the wire, and the trailing wire-end is processed as described above. After processing, by means of a relative movement of the conveyor elements 21, 31, the transporting system is brought into the open position, whereupon the wire 3 rests in a sinuous line adjacent to the conveyor elements 21, 31, and then falls in downward direction into the receptacle 13. Alternatively, towards the end of the wire transport, the relative movement of the conveyor elements 21, 31 can be laid over the transporting movement.

The belt-drive 2 is equipped with a length-measuring system, for example an encoder wheel and an opposing wheel, wherein the desired length of wire is conveyed and separated with great accuracy. The position of the advancing wire-end 3.1, and the movements that it executes, are thereby known to the overarching control 3.1. The control synchronizes the transporting system 11 and the conveyor elements 21, 31 with the length-measuring system of the belt-drive 2.

Figure 4:
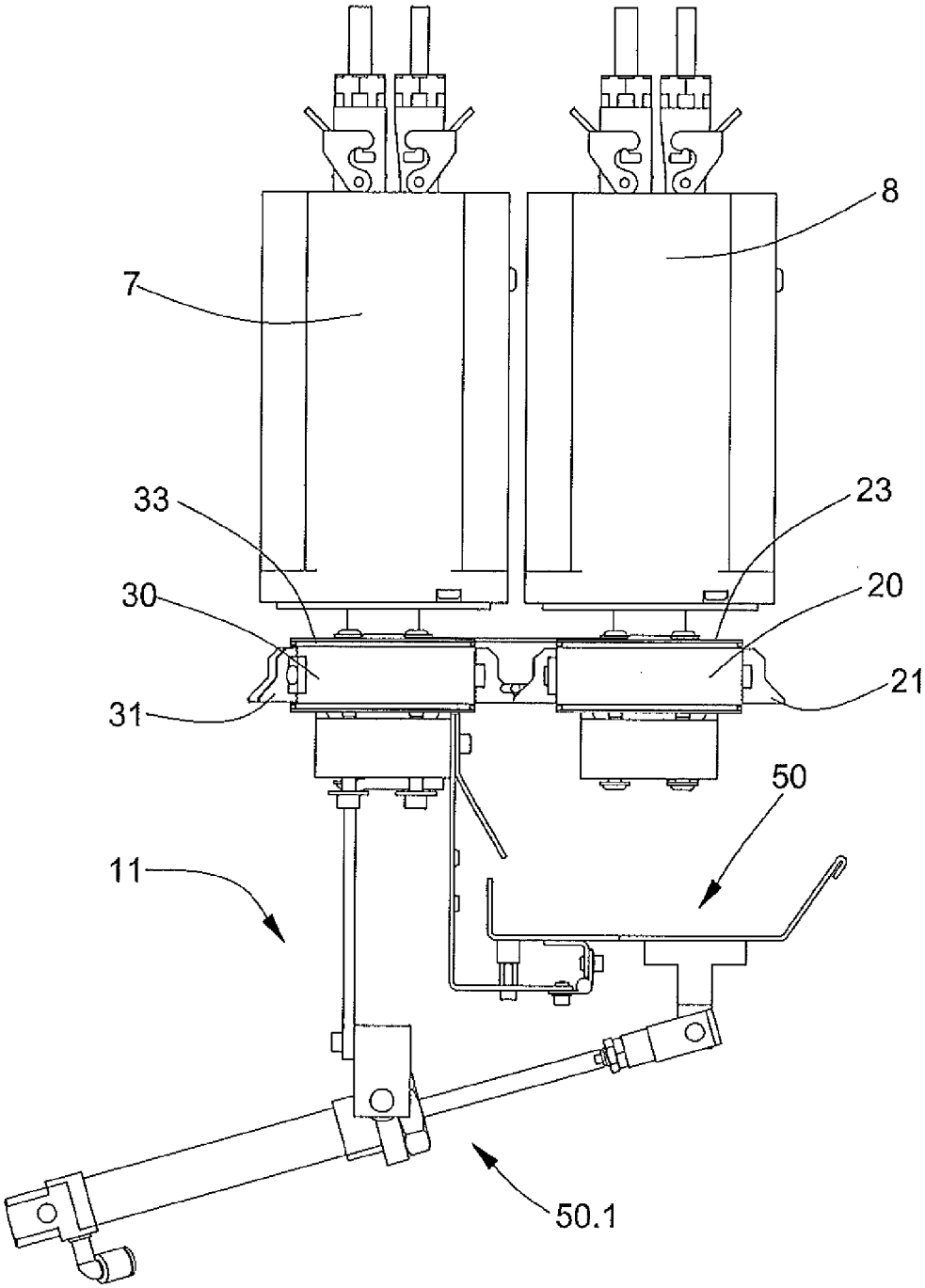
FIG. 4, a plan view of the transporting system with a receptacle for the processed wires.

FIG. 4 shows an elevation of the transporting system 11, in which the receptacle 13 for the processed wires that is shown in FIG. 1 is embodied as a swivelable tray 50. During and after processing, each wire 3 lies between the belts 20, 30 and then, in the open position of the transporting system 11 or, in the case of conveyor elements 21, 31 that are moved away from each other, falls in downward direction into the tray 50. When the tray 50 is full, or after a batch of wires has been processed, an actuator 50.1, for example a pneumatic cylinder 50, swivels the tray 50, and the processed wires 3 arrive in a not-shown container.

Figure 5A:
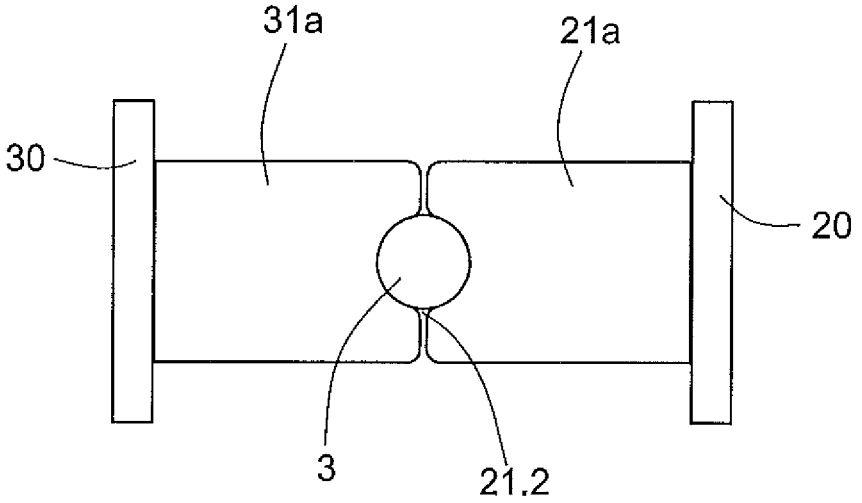
FIG. 5*a*, details of the conveyor elements for gripping and transporting the wire.
Figure 5:
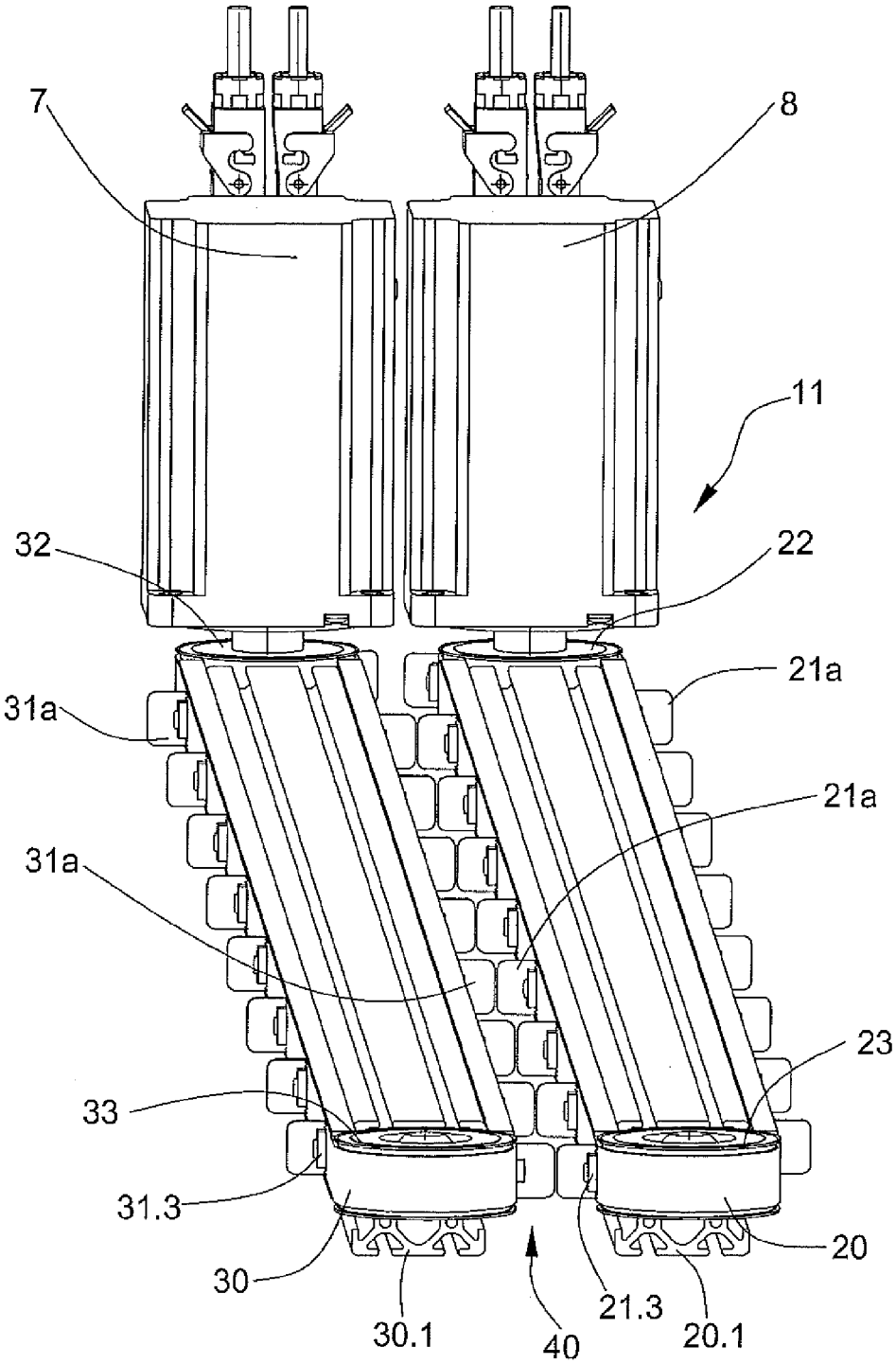
FIG. 5, a three-dimensional representation of the transporting system for gripping and transporting the wire.

FIG. 5 and FIG. 5*a* show a variant embodiment of the transporting system 11 for gripping and transporting the wire 3.

In this variant embodiment, in the closed position of the transporting system 11 the conveyor elements 21*a*, 31*a* grip the wire 3. The wire 3 can hence be pulled into the machine by means of the conveyor elements 21*a*, 31*a*. The conveyor elements 21*a*, 31*a* can, for example, be elastic, and formed in such manner that the conveyor elements 21*a* of the first belt 21 and the conveyor elements 31*a* of the second belt 30 are in mutual contact. The conveyor elements 21*a*, 31*a* can also be embodied in such manner that two oppositely-situated conveyor elements 21*a*, 31*a* completely, or only partly, for example with an upward-facing aperture, embrace the wire 3. FIG. 5*a* shows a variant in which the oppositely-situated conveyor elements 21*a*, 31*a* form an aperture 21.2 and embrace the wire 3.

The conveyor elements 21*a*, 31*a* can also be embodied according to their respective function. For example, a pair of oppositely lying conveyor elements 21*a*, 31*a* can be embodied in such manner that, depending on the type of processing (for example, a crimped contact), they accept the advancing wire-end 3.1 at the entrance 40 particularly efficiently and protectively while, for precise guidance of the wire, the other conveyor elements 21*a*, 31*a* of the belts 20, 30 have a narrower aperture 21.2.

The guide elements 21*a*, 31*a* of the one belt 20, 30 can also be embodied in such manner that, through their contact with the guide elements 21*a*, 31*a* of the other belt 20, 30, they fold away, or move in other desired manner, for example to release the wire 3.

For processing and guiding long wires 3, a plurality of transporting systems 11 can be sequentially arranged or cascaded in the direction in which the wire is transported. The velocities of the transporting systems 11 are synchronized, and the positions of the conveyor elements coordinated, in such manner that the release, or acceptance, of the advancing wire-end 3.1 is possible at full velocity.

The transporting system 11 can also be used as a temporary store for the processed wires 3. For this purpose, below the transporting system 11 according to FIG. 1, a second transporting system 11 with upwardly open conveyor elements is arranged. When the conveyor elements of the lower transporting system 11 are in the closed position, the wires 3 that fall from the upper transporting system 11 onto the lower transporting system remain lying there. The temporarily stored wires 3 can now either be transported further in the longitudinal axis of the wire, if all conveyor elements are in the closed position, or, if the conveyor elements are in the open position, the wires are released and the wires 3 fall in downward direction into the receptacle 13 or into the tray 50.

In a further variant embodiment, the transporting system can be provided with a further drive, which moves the two halves horizontally toward each other and away from each other perpendicular to the longitudinal axis of the wire, or in the direction of the longitudinal axis of the wire, whereby the conveyor elements 21, 31 are moved into the closed position. In addition to, or instead of, the conveyor elements, on one or both of the belts a continuous protuberance can be applied below, or additionally above, so that the wire is continuously guided.

Both belts 20, 30 can also be moved with only one common drive, or coupled with the belt-drive 2. A switchable coupling between the two belts can then help ensure that the two belts are relatively movable codirectionally and/or contradirectionally.

Alternatively to the two belts 20, 30, link-type belts are possible; for example, instead of the belts, chain drives can be provided.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

I claim:

1. A wire transporting system for a wire-processing machine, the wire transporting system comprising:

a first conveyor device, the first conveyor device including a first set of conveyor elements; and a second conveyor device, the second conveyor device including a second set of conveyor elements, the first and second sets of conveyor elements being driven in a wire transport direction relative to each other to place the first set of conveyor elements and the second set of conveyor elements into a wire transport position, the first and second sets of conveyor elements further being driven in a wire transport direction relative to each other to place the first set of conveyor elements and the second set of conveyor elements into a wire release position.

2. The wire transportation system according to claim 1 wherein the first conveyor device includes a first endless belt coupled to a first set of pulleys, and the second conveyor device includes a second endless belt coupled to a second set of pulleys, the first set of conveyor elements being arranged on the first endless belt and the second set of conveyor elements being arranged on the second endless belt.

3. The wire transporting system according to claim 2 wherein in the wire transport position, a conveyor element of the first set of conveyor elements is adjacent a conveyor element of the second set of conveyor elements to form a concave cross-sectional profile for receiving a wire.

4. The wire transporting system according to claim 2 wherein in the wire transport position, a conveyor element of the first set of conveyor elements is adjacent a conveyor element of the second set of conveyor elements to form an aperture for receiving a wire.

5. The wire transportation system according to claim 2 wherein the first endless belt and the second endless belt are relatively driven by rotation of at least one of the first and second sets of pulleys to position ones of the conveyor elements of the first set of conveyor elements adjacent ones of the conveyor elements of the second set of conveyor elements in the wire transport position.

6. The wire transportation system according to claim 5 wherein the first endless belt and the second endless belt are relatively driven by rotation of at least one of the first and second sets of pulleys to move the adjacent conveyor elements apart into the wire release position.

7. The wire transportation system according to claim 2 wherein the first endless belt and the second endless belt extend in parallel directions.

8. A wire-processing machine, comprising:

a wire transporting system, the wire transporting system comprising, a first conveyor device, the first conveyor device including a first set of conveyor elements, and a second conveyor device, the second conveyor device including a second set of conveyor elements, the first and second sets of conveyor elements being driven in a wire transport direction relative to each other to place ones of the conveyor elements of the first set of conveyor elements and ones of the conveyor elements of the second set of conveyor elements adjacent in a wire transport position, the first and second sets of conveyor elements further being driven in a wire transport direction relative to each other to move the adjacent conveyor elements apart in parallel directions into a wire release position.

9. A wire-processing method, comprising:

bringing first and second sets of conveyor elements of a wire transporting system into a wire transport position, the wire transporting system including first and second conveyor devices, the first conveyor device including the first set of conveyor elements and the second conveyor device including the second set of conveyor elements;

receiving a leading end of a wire at an entrance of the wire transporting system;

pulling the wire out of a wire-processing machine using the wire transportation system; and driving in a wire transport direction one of the first and second sets of conveyor elements relative to the other of the first and second conveyor elements to place the first and second sets of conveyor elements into a wire release position.

* * * * *